US009320330B2

(12) United States Patent
Cooke et al.

(10) Patent No.: US 9,320,330 B2
(45) Date of Patent: Apr. 26, 2016

(54) BEADING BOARD DEVICE FOR A TABLET COMPUTER AND TABLET COMPUTER PROGRAM FOR USE WITH SAME

(71) Applicant: EK Success Ltd., Clifton, NJ (US)

(72) Inventors: Cory Cooke, Clifton, NJ (US); Ross Exley, Morristown, NJ (US); Matt Sweeney, Bloomsfield, NJ (US)

(73) Assignee: EK SUCCESS LTD., Woodridge, IL (US)

( * ) Notice: Subject to any disclaimer, the term of this patent is extended or adjusted under 35 U.S.C. 154(b) by 224 days.

(21) Appl. No.: 13/833,483

(22) Filed: Mar. 15, 2013

(65) Prior Publication Data

US 2014/0120501 A1 May 1, 2014

Related U.S. Application Data

(60) Provisional application No. 61/720,183, filed on Oct. 30, 2012.

(51) Int. Cl.

| | |
|---|---|
| ***A44C 27/00*** | (2006.01) |
| ***A63F 9/06*** | (2006.01) |
| ***B44C 3/12*** | (2006.01) |
| *A63F 3/00* | (2006.01) |
| *A63F 9/24* | (2006.01) |

(52) U.S. Cl.

CPC . *A44C 27/00* (2013.01); *A63F 9/06* (2013.01); *B44C 3/123* (2013.01); *A63F 2003/00343* (2013.01); *A63F 2009/2457* (2013.01); *A63F 2250/485* (2013.01)

(58) Field of Classification Search

CPC ..... A44C 27/00
USPC ..... 434/81, 88
See application file for complete search history.

(56) References Cited

U.S. PATENT DOCUMENTS

| | | | |
|---|---|---|---|
| 3,191,937 | A | 6/1965 | Kropinski |
| 3,566,529 | A | 3/1971 | Kner et al. |
| 5,362,950 | A | 11/1994 | Larocque |
| 6,241,528 | B1 | 6/2001 | Myers |
| 6,646,866 | B2 | 11/2003 | Kao |
| 7,025,274 | B2 | 4/2006 | Solomon et al. |

(Continued)

FOREIGN PATENT DOCUMENTS

| | | | |
|---|---|---|---|
| FR | 1523504 | A | 5/1968 |
| GB | 2498410 | A | 7/2013 |
| WO | WO-2005075216 | A1 | 8/2005 |

OTHER PUBLICATIONS

Search Report & Written Opinion for PCT/US2013/067271, Feb. 19, 2014.

*Primary Examiner* — Xuan Thai
*Assistant Examiner* — Robert P Bullington
(74) *Attorney, Agent, or Firm* — McDermott Will & Emery LLP

(57) ABSTRACT

A beading board for arranging cylindrical beads in a pattern displayed on an electronic display device. The beading board includes a frame configured to receive the electronic display device, and a board including a plurality of bead receivers. The board is cooperatively received by the frame and configured to be supported over the electronic display device such that the electronic display device is viewable through the board. A system and method for generating and displaying a beading pattern on the electronic display device is also provided.

17 Claims, 13 Drawing Sheets

(56) References Cited

U.S. PATENT DOCUMENTS

| | | | | |
|---|---|---|---|---|
| 7,216,448 | B2 | 5/2007 | Hsu | |
| 7,609,512 | B2 | 10/2009 | Richardson et al. | |
| D647,526 | S | 10/2011 | Vandiver et al. | |
| 8,044,942 | B1 | 10/2011 | Leonhard et al. | |
| 8,125,787 | B2 | 2/2012 | Chen et al. | |
| 2004/0163749 | A1 | 8/2004 | Verschoor | |
| 2005/0178693 | A1* | 8/2005 | Gupta | 206/574 |
| 2005/0245302 | A1* | 11/2005 | Bathiche et al. | 463/1 |
| 2006/0274493 | A1* | 12/2006 | Richardson et al. | 361/683 |
| 2007/0126751 | A1* | 6/2007 | Crona | 345/589 |
| 2010/0084291 | A1 | 4/2010 | Dayton et al. | |
| 2011/0303578 | A1 | 12/2011 | Mizell et al. | |
| 2012/0113034 | A1 | 5/2012 | McDermid | |

* cited by examiner

BEADING BOARD DEVICE FOR A TABLET COMPUTER AND TABLET COMPUTER PROGRAM FOR USE WITH SAME

CROSS REFERENCE TO RELATED APPLICATION

This application claims the benefit of and priority to U.S. Provisional Patent Application No. 61/720,183, filed Oct. 30, 2012, the entire contents of which are hereby incorporated by reference herein.

TECHNICAL FIELD

The present disclosure generally relates to a beading board device for a tablet computer. The present disclosure also generally relates to a computer program executable by the tablet computer that facilitates use of the beading board device with the tablet computer.

BACKGROUND

Hot melt cylindrical craft beads, such as PERLER® brand beads, are hollow, cylindrical beads that can be melted and fused together when subjected to an appropriate amount of heat. Hot melt beads come in a wide variety of colors, and although many sizes are available, standard hot melt beads are approximately the size of a pencil eraser. Hot melt beads can be used to make a virtually unlimited variety of craft projects, the most common being two-dimensional images whereby different colors of beads are arranged in a specific pattern to resemble, for example, a flower, a butterfly, a star, and the like.

To create a hot melt bead project a user arranges the beads onto a pegboard. The pegboard may be specifically configured and shaped to resemble the object being made, or may be rectangular, circular, or some other generic shape, and it will then be up to the user to arrange the beads in the desired pattern. The pegboards include a plurality of upwardly extending pegs, each sized to fit within the central opening of an individual bead. The pegs are arranged and spaced about the pegboard so that when individual beads are placed on adjacent pegs, the beads are touching or very nearly touching one another.

After the user has arranged the desired pattern on the pegboard, the user applies heat, for example, by way of a traditional clothing iron, to the exposed upper surface of the arrangement of beads. The heat melts the upper ends of the beads such that adjacent beads fuse together. Once one side of the arrangement of beads has been fused together, the user may then remove the arrangement of beads from the pegboard. If desired, the user may also fuse the opposite side of the arrangement of beads.

SUMMARY

In some aspects, a beading board is provided for arranging cylindrical beads in a pattern. The pattern may be displayed on an electronic display device. The beading board includes a frame configured to receive the electronic display device, and a board including a plurality of bead receivers. The board is cooperatively received by the frame and configured to be supported over the electronic display device such that the electronic display device is viewable through the board.

In other aspects, the plurality of receivers may include a plurality of equidistantly spaced pegs arranged in rows and columns. The frame may define a cavity for receiving the electronic display device. The frame may define a central recess positioned above the cavity, and the central recess may be configured to receive and orient the board. The frame may include a top surface surrounding the central recess, and when the board is received by the central recess, tops of the plurality of bead receivers may be located below the top surface of the frame. The board may include upwardly extending handles, and when the board is received by the central recess, the handles may extend above the top surface of the frame. The frame may include a plurality of resilient tabs extending into the cavity and configured for engagement with the electronic display device. The frame may include a perimeter wall defining the cavity, and the resilient tabs may be coupled to and extend inwardly from the perimeter wall. The frame may include a plurality of storage compartments spaced along at least one edge.

In some aspects, a beading board is provided for arranging cylindrical beads in a pattern. The pattern may be displayed on an electronic display device. The beading board includes a frame having a top surface, a perimeter wall defining a lower cavity, and a central recess extending downwardly from the top surface. A board includes a base portion and a plurality of bead receivers extending upwardly from the base portion. The board is removably positionable within the central recess, and the cavity is viewable through the board when the board is positioned in the central recess.

In other aspects, the central recess may be defined by inwardly angled sidewalls, and the sidewalls may support the board when the board is positioned in the central recess. Tops of the plurality of bead receivers may be located below the top surface when the board is positioned in the central recess. The board may include at least one upwardly extending handle, and the handle may extend above the top surface when the board is positioned in the central recess. The beading board may also include a plurality of resilient tabs coupled to the perimeter wall and extending inwardly into the cavity.

In some aspects, a system for arranging cylindrical beads in a pattern is provided and includes a non-transitory computer readable medium adapted to control a computer and providing code segments for displaying a bead pattern on an electronic display device. The system also includes a beading board having a frame configured to receive the electronic display device, and a board supported by the frame over the electronic display device. The board includes a plurality of bead receivers, and the bead pattern on the electronic display device is viewable through the board.

In other aspects, the bead receivers may be arranged in a receiver pattern, and the bead pattern on the display may correspond to the receiver pattern of the bead receivers. The non-transitory computer readable medium may further provide a code segment for receiving a user selection of an image, and a code segment for generating the bead pattern from the image selected by the user. The non-transitory computer readable medium may further provide a code segment for receiving user modifications to the bead pattern. The non-transitory computer readable medium may also further provide a code segment for calculating a total number of cylindrical beads required by the bead pattern and displaying the total number of cylindrical beads on the display.

In some aspects, a non-transitory computer readable medium is adapted to control an executable computer readable program code embodied therein. The executable computer readable program code is for implementing a method for displaying a bead pattern on an electronic display device. The method includes receiving a user selection of an image for generating the bead pattern, and generating the bead pattern based on the selected image.

In other aspects, the method may further comprise receiving user input for modifying the generated bead pattern. Generating the bead pattern may include approximating the selected image using a plurality of circles having a predetermined size and colors selected from a predetermined color set. The method may further comprise calculating a total number of cylindrical beads required by the bead pattern and displaying the total number of cylindrical beads on the electronic display device.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

Figure 1:
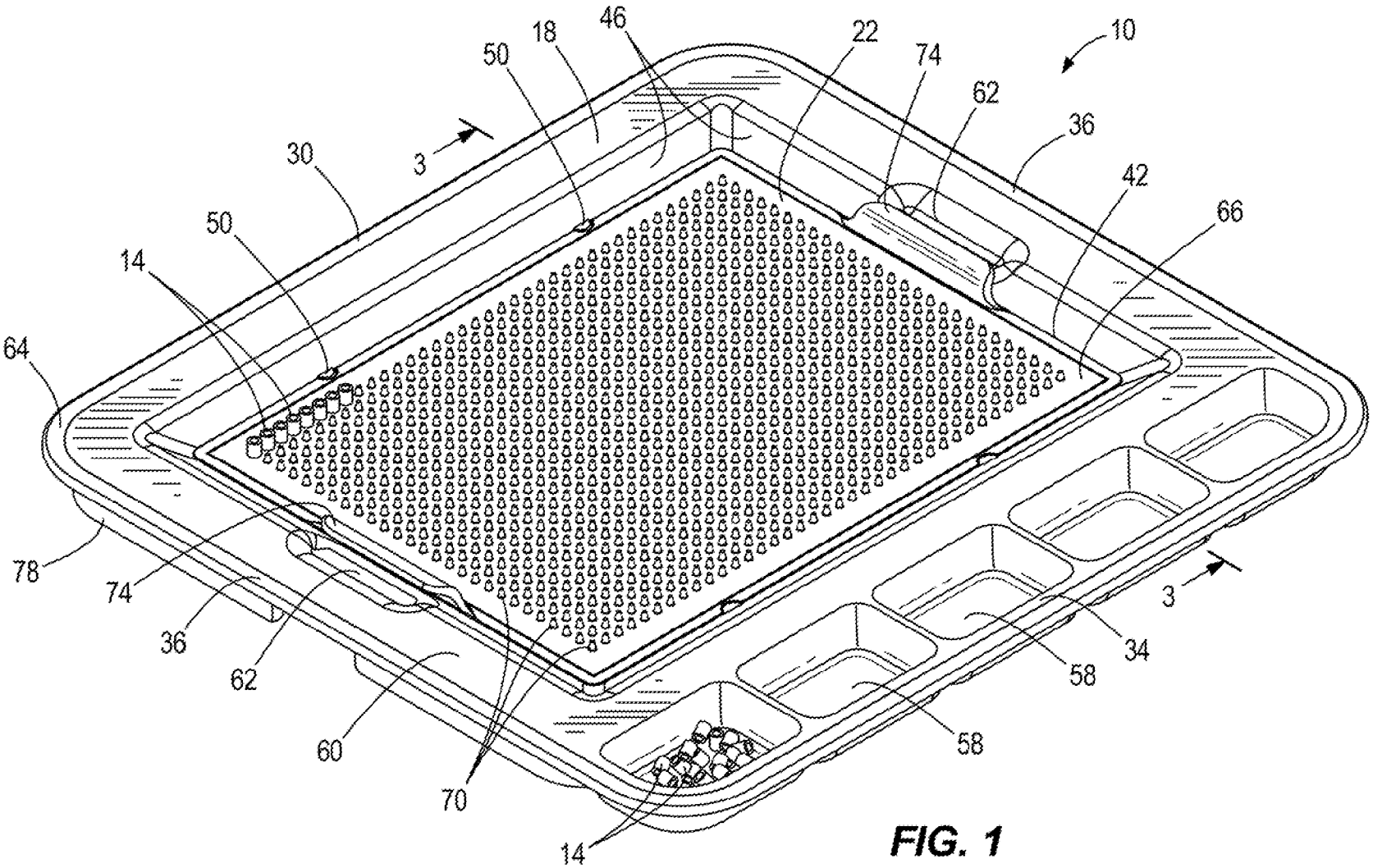
FIG. 1 is a perspective view of a beading board for a tablet computer according to one embodiment.

The components in the drawings are not necessarily to scale, emphasis instead being placed upon clearly illustrating the principles of the present disclosure.

DETAILED DESCRIPTION

While the beading board and associated computer programs discussed herein are susceptible of embodiments in many different forms, there is shown in the drawings, and will herein be described in detail, preferred embodiments with the understanding that the present description is to be considered as an exemplification of the principles of the beading board and associated computer programs, and are not intended to limit the broad aspects of the disclosures to the embodiments illustrated.

FIGS. 1-4 illustrate a beading board 10 for arranging hot melt beads 14 in creative patterns and arrangements. The beading board 10 can be used as a stand-alone item for creating patterns and arrangements of beads 14, but also is configured for cooperative use with a tablet computer T (FIGS. 2-4, hereinafter "tablet") that may be executing specialized software (discussed below) that can be provided in combination with the beading board 10 and configured to assist in the creation of patterns and arrangements of beads 14 on the beading board 10.

Figure 2:
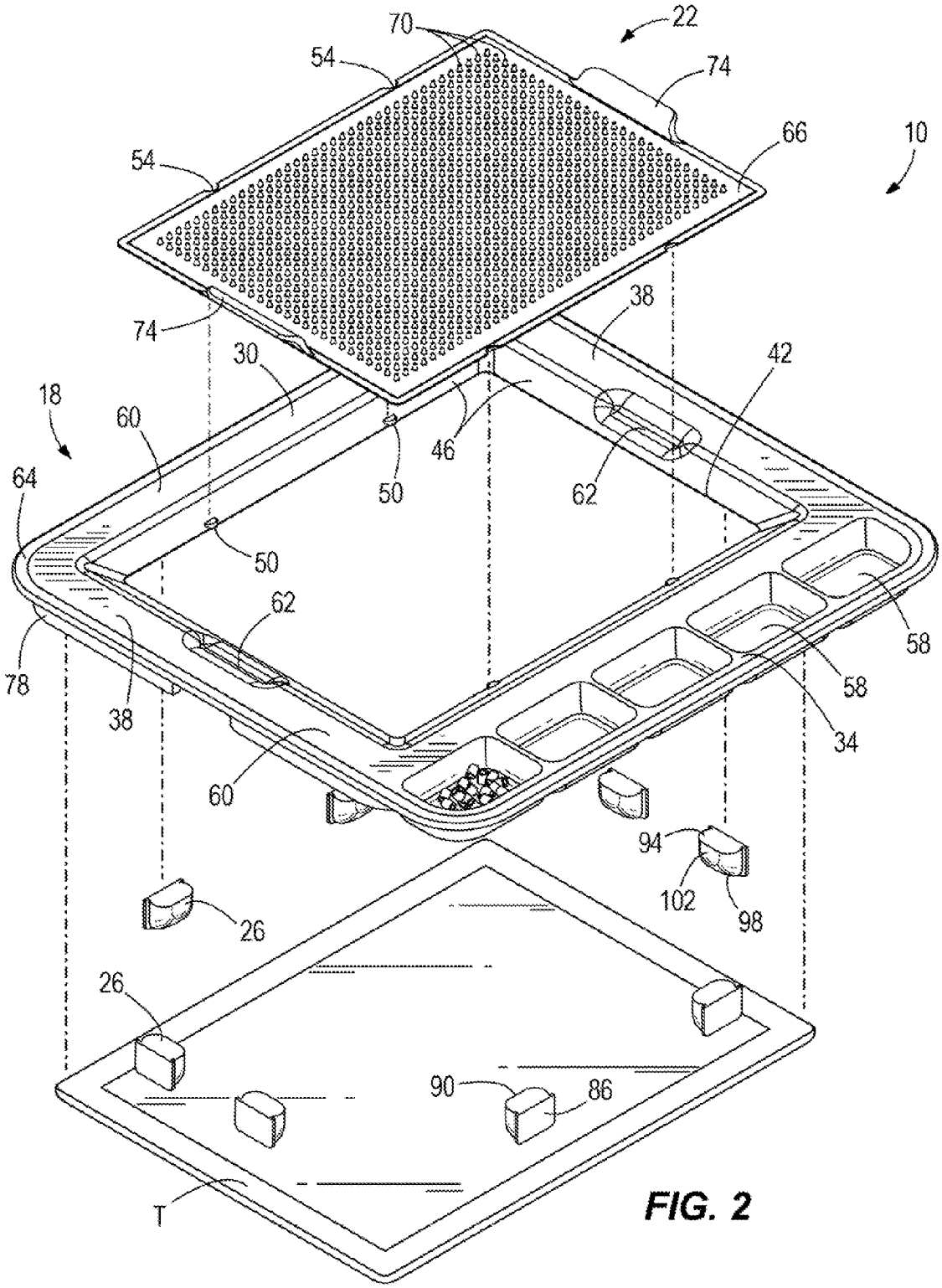
FIG. 2 is an exploded perspective view of the beading board of FIG. 1.

The beading board 10 includes a generally rectangular outer frame 18, a pegboard 22 supported by the outer frame 18, and a plurality of resilient and/or flexible tabs 26 (FIGS. 2-4) configured to engage the tablet T and properly position the tablet T with respect to the pegboard 22. The frame 18 includes an upper edge 30, a lower edge 34, and a pair of side edges 38 extending between the upper and lower edges 30, 34. The frame 18 also includes a central recess 42 defined by inwardly angled sidewalls 46. The central recess 42 is configured to receive and orient the pegboard 22 with respect to the frame 18. As seen in FIG. 2, the sidewalls 46 may be provided with semi-circular projections 50 configured to fit within corresponding semi-circular recesses 54 provided on the pegboard 22 so that when the pegboard 22 is received by the central recess 42 it is positively located with respect to the frame 18.

The frame 18 also includes a plurality of cavities or compartments 58 spaced along the lower edge 34 and recessed with respect to a top surface 60 of the frame 18. The compartments 58 can be used to hold beads 14 or any other items the user desires. For example, a user may fill each compartment 58 with a single color of beads 14 to speed up the beading process. The side edges 38 of the frame 18 each define a concave recess 62 positioned substantially adjacent the central recess 42. The frame 18 may be formed of transparent ABS plastic or other suitable materials. In some embodiments an outer edge portion 64 of the frame 18 may be formed as an overmolded thermoplastic elastomer to provide a non-slip outer grip portion on the frame 18.

The pegboard 22 preferably is formed of a transparent and heat-resistant material. By way of example only, general purpose polystyrene (GPPS) is one suitable material for formation of the pegboard. The pegboard 22 is generally rectangular and is sized and configured to fit within the central recess 42 defined by the frame 18. The pegboard 22 includes a substantially flat base portion 66 and an array of bead receivers in the form of a plurality of pegs 70 extending generally upwardly from the base portion 66. In the illustrated embodiment, the pegs 70 are substantially frusto-conical in shape, which can simplify the process of positioning beads 14 on the pegs 70. However, other shapes, such as cylindrical, frusto-spherical, and the like, may also be used. Furthermore, in some embodiments the array of receivers may be in the form of a plurality of recesses arranged similarly to the pegs 70 and sized and configured to receive the beads 14. In the illustrated embodiment, the bead receivers (e.g. the pegs 70) are equidistantly spaced and are arranged in aligned sets of rows and columns. In other embodiments, the bead receivers may be arranged such that adjacent rows or columns are offset or staggered with respect to one another. The pegboard 22 also includes a pair of upwardly extending handle portions 74. The handle portions 74 are sized and positioned for alignment with the concave recesses 62 formed in the side edges 38 of the frame 18, and extend above the top surface 60 of the frame 18 when the pegboard 22 is positioned in the central recess 42. The concave recesses 62 make it easier to grasp the handle portions 74 for removing the pegboard 22 from the frame 18.

Figure 3:
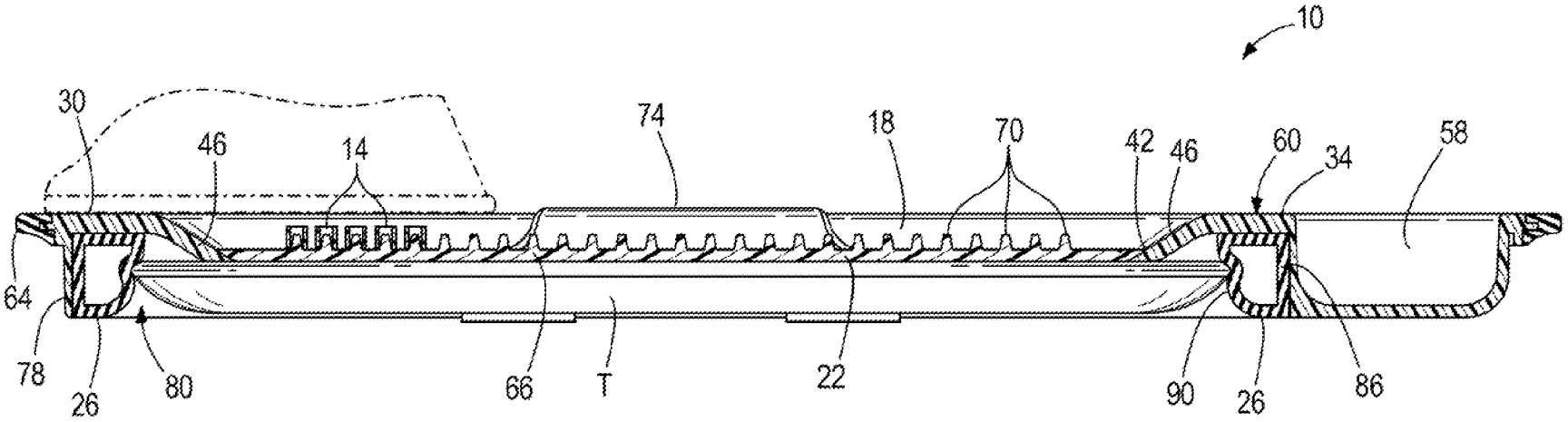
FIG. 3 is section view taken along line 3-3 of FIG. 1.
Figure 4:
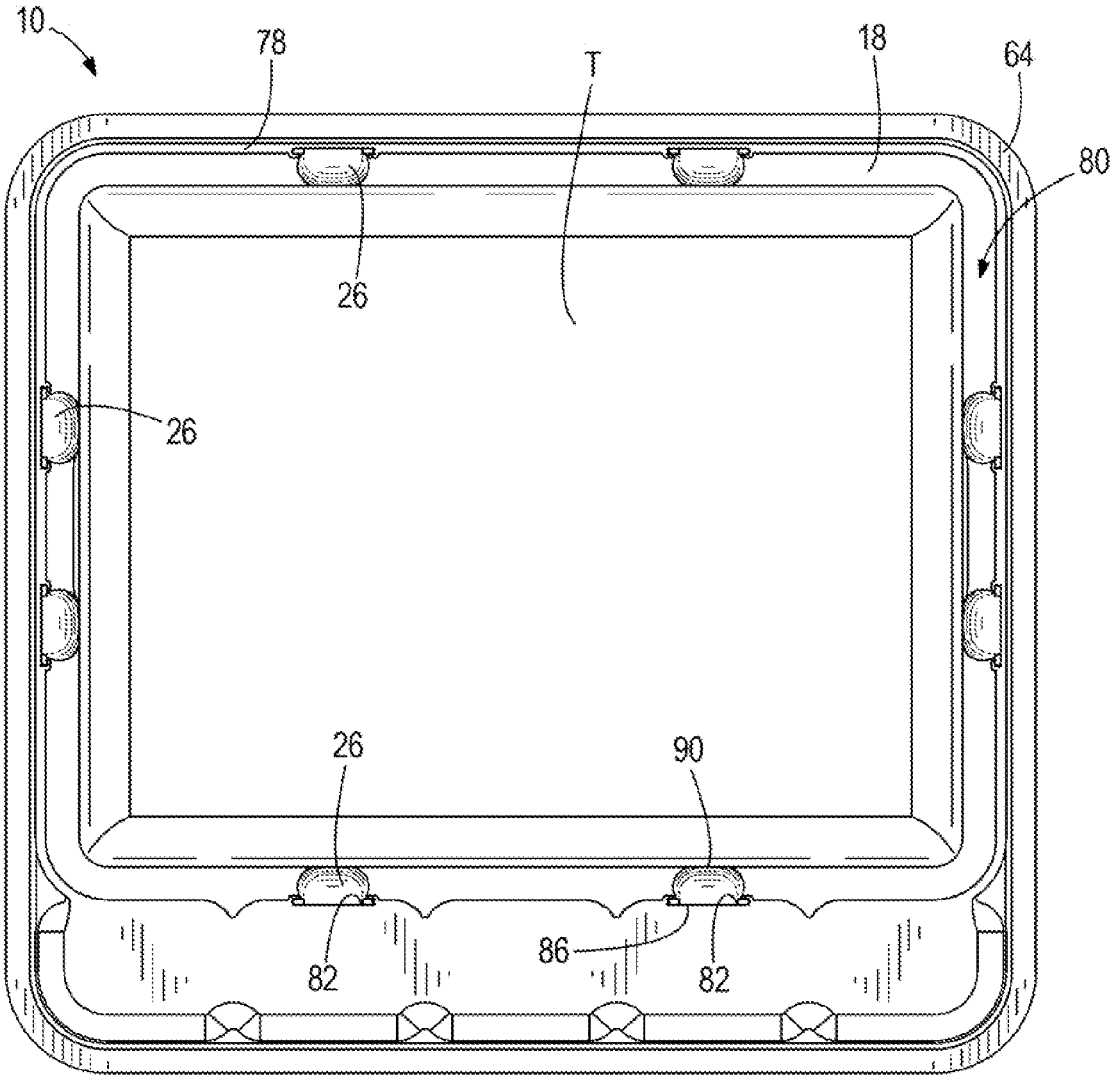
FIG. 4 is a bottom view of the beading board of FIG. 1.

As best shown in FIGS. 3 and 4, the underside of the frame 18 includes a generally downwardly extending perimeter wall 78 that defines a cavity 80. The cavity 80 is sized and configured to receive the tablet T and communicates with the central recess 42. The perimeter wall 78 includes a plurality of securement locations 82 adapted to receive and secure the tabs 26. The resilient tabs 26 are coupled to the perimeter wall 78 and are positioned to receive the tablet T and properly locate (e.g., center) the tablet T with respect to the central recess 42. In some embodiments, the tabs 26 are sufficiently compliant such that the tabs 26 are equally capable of receiving and locating the tablet T with respect to the central recess 42 regardless of whether the tablet T is encased by a protective cover (not shown), which generally enlarges the outer dimensions of the tablet T.

Referring also to FIG. 2, although different configurations may be used, the illustrated tabs 26 each include a generally rectangular securement portion 86 configured to fit within the securement locations 82 provided on the frame 18. The tabs 26 each also include an engagement portion 90 having a substantially flat top surface 94, a curved guide surface 98 that extends along the bottom and sides of the engagement portion 90, and a substantially flat engagement surface 102 that contacts the edges of the tablet T when the frame 18 is positioned over the tablet T. To position the frame 18 over the tablet T, the tablet T may be positioned on a flat support surface and the frame 18 may be positioned generally over the tablet T with the central recess 42 approximately centered with respect to the tablet's screen. The frame 18 is then pressed gently downwardly onto the tablet T, which causes the curved guide surfaces 98 to contact the edges of the tablet T. The tabs 26 deflect as needed to accommodate the tablet T (and protective case, if present) until the tablet T is fully received between the tabs 26 and is positioned in the cavity 80. The generally uniform resilience of the tabs 26 tends to center the tablet T with respect to the frame 18 such that the central recess 42 is substantially aligned with the display screen of the tablet T.

As seen in FIG. 3, the tabs 26 may be hollow. By way of example only, the tabs 26 may comprise a thermo plastic elastomer. In some embodiments, the securement portions 86 of the tabs 26 may be adhesively joined to the securement locations 82 on the frame 18. It should be appreciated that the illustrated resilient tabs 26 are one example of a suitable mechanism for receiving and locating the tablet T with respect to the central recess 42, and that leaf springs, coil springs, other resilient materials, and the like may also be used.

As discussed below, computer software configured for use with the beading board 10 may be installed on the tablet T such that the display of the tablet T can be used as a guide for the placement of beads 14 on the pegboard 22. The beading board 10 is configured such that, with the tablet T secured and located by the tabs 26, the user can see the display of the tablet T through the transparent pegboard 22. The user can then position beads 14 on the pegboard 22 by matching bead colors and locations with colors and locations shown on the display of the tablet T. Once the bead arrangement is complete, the user can grasp the handle portions 74 of the pegboard 22 and lift the pegboard 22 away from the frame 18 and onto a support surface without disturbing the arrangement of beads 14. The user can then apply heat to the top surface of the beads 14 using, for example, a household iron to fuse the top surfaces of the beads 14 together. Once the beads 14 are fused together, the arrangement of beads can be removed from the pegboard 22 and another project can be initiated. It is up to the user whether he or she wants to also fuse together the other side of the design.

As shown in FIG. 3, the frame 18, pegboard 22, and center recess 42 are configured such that when the pegboard 22 is supported on the frame 18, the top surface 60 of the frame 18 is at a higher elevation than the tops of the pegs 70 and also at a higher elevation than the top surfaces of the beads 14. In this way, if a user mistakenly attempts to fuse the beads 14 without removing the pegboard from the frame 18, the user generally will be unable to apply a heat source, such as a household iron (shown in phantom in FIG. 3), to the tops of the beads 14. In this regard, by locating the pegboard 22 within the central recess 42 defined by the frame 18, the likelihood of a user heating and damaging the tablet T by trying to fuse the beads 14 while the pegboard is 22 positioned in the frame 18 may be reduced. Although not shown in the figures, the beading board 10 may also include a combination stylus and tweezers device. One end of the stylus and tweezers device may be configured as a stylus for operating the tablet T, and the opposite end of the stylus and tweezers device may be configured as a pair of tweezers for grasping and placing beads 14 on to the pegboard.

Referring now to FIGS. 5-12, a method and system for generating a hot melt bead pattern for use with a pegboard are described. The system receives from a user a selection of an image from which the user wishes to create a hot melt bead pattern. The user may also provide his or her own image for creating the hot melt bead pattern. Based on the user-selected image, the system generates a hot melt bead pattern for use with a pegboard such as, for example, pegboard 22. The system may also provide a user interface through which the user may make modifications to the hot melt bead pattern that is generated by the system. The system may also facilitate sharing of the generated hot melt bead pattern on the Internet, or facilitate purchasing beads for use with the generated hot melt bead pattern.

Figure 5:
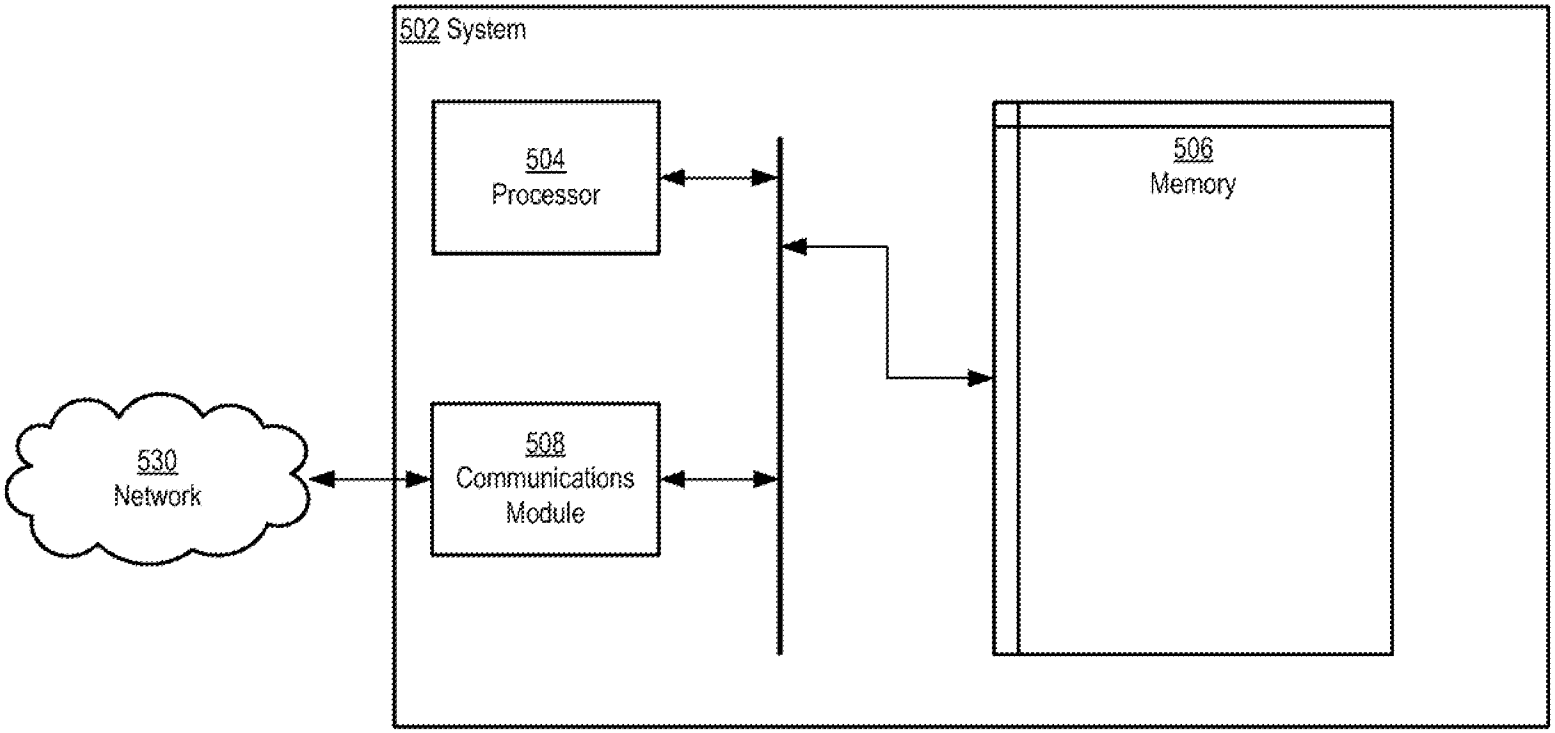
FIG. 5 is a block diagram illustrating an example system for generating a hot melt bead pattern for use with a pegboard.

FIG. 5 is a block diagram 500 illustrating an example system 502 for generating a hot melt bead pattern for use with a pegboard. The system 502 may be implemented at an electronic device such as, for example, tablet T. However, the system 502 may be implemented or hosted at any electronic device, such as, for example, a desktop computer, a laptop computer, a mobile device (e.g., a smartphone, tablet computer, or PDA), a set top box (e.g., for a television), television, video game console, home appliance (e.g., a refrigerator, microwave oven, washer or dryer) or any other device having a touch interface, processor, memory, and communications capability for interacting with the user, running a computer program or executing logic for generating a hot melt bead pattern for use with a pegboard.

The system 502 includes a processor 504 and a memory 506. The system 502 may also include a communications module 508, and may be connected to a network 530 via the communications module 508. The network 530 may be, for example, any one or more of a personal area network (PAN), a local area network (LAN), a campus area network (CAN), a metropolitan area network (MAN), a wide area network (WAN), a broadband network (BBN), the Internet, and the like.

The communications module 508 is configured to interface with the network 530 to send and receive information, such as data, requests, responses, and commands to other electronic devices or systems on the network 530. The data sent and received through the communications module 508 may also include requests for receiving images for generating hot melt bead patterns, sharing hot melt bead patterns on the Internet, or purchasing beads for use with the hot melt bead pattern. The communications module 508 may be, for example, modems, Ethernet cards or mobile broadband adaptors.

The system 502 also includes a memory 506 which stores information pertaining to the hot melt bead patterns and the images for generating the hot melt bead patterns. The processor 504 is configured to execute instructions, such as instructions physically coded into the processor, instructions received in the form of software from the memory 506, or a combination of both. For example, the processor 504 is configured to execute instructions to receive a selection of an image for generating a hot melt bead pattern from a user, and generate the hot melt bead pattern based on the selected image. The processor 504 may also be configured to execute instructions for receiving user input for modifying the generated hot melt bead pattern, and modifying the generated hot melt bead pattern based on the user input.

Example operations for generating a hot melt bead pattern for use with a peg board is discussed with reference to various user interfaces shown in FIGS. 6-11. The operations may be performed by a system such as, for example, system 502.

FIGS. 6-11 show that the system is hosted on a tablet computer. However, the system may also be hosted on other types of electronic devices.

Figure 6:
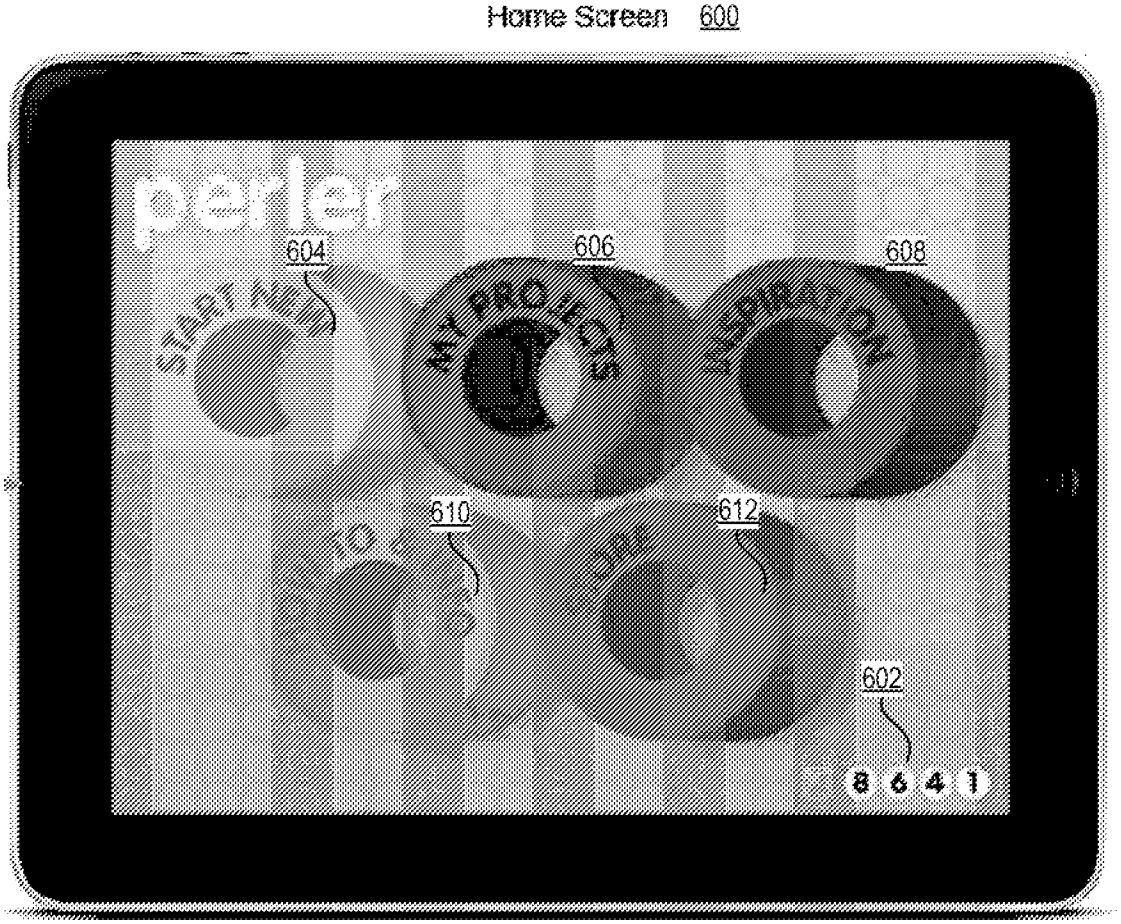
FIGS. 6-11 illustrate various user interfaces provided in accordance with the subject technology.

FIG. 6 illustrates a home screen 600 which may be displayed to the user. The home screen 600 includes user-selectable menus represented in images of beads of different colors. The user-selectable menus include "Start New" menu 604, "My Projects" menu 606, "Inspiration" menu 608, "How To & Info" menu 610 and "Store" menu 612. When the tablet computer on which the system is hosted is tilted, the home screen 600 may be animated such that images of the beads are also tilted to the side, showing the sides of the beads. Such animation may provide the illusion of 3D to the user.

The home screen 600 also includes a bead counter 602 which displays the total number of beads that are represented in all of the hot melt bead patterns that are stored in the system. The number of beads is updated each time the home screen 600 is displayed to the user. When the bead counter 602 is updated, an animation may be displayed to the user in which the circles encompassing each digit of the bead counter 602 flips vertically to reveal the updated value on the other side.

Before the home screen 602 is displayed to the user, a predetermined animation may be displayed, after which the user-selectable menus "pop" into the home screen as the predetermined animation fades away. The predetermined animation may be, for example, an animation of a logo.

Figure 7:
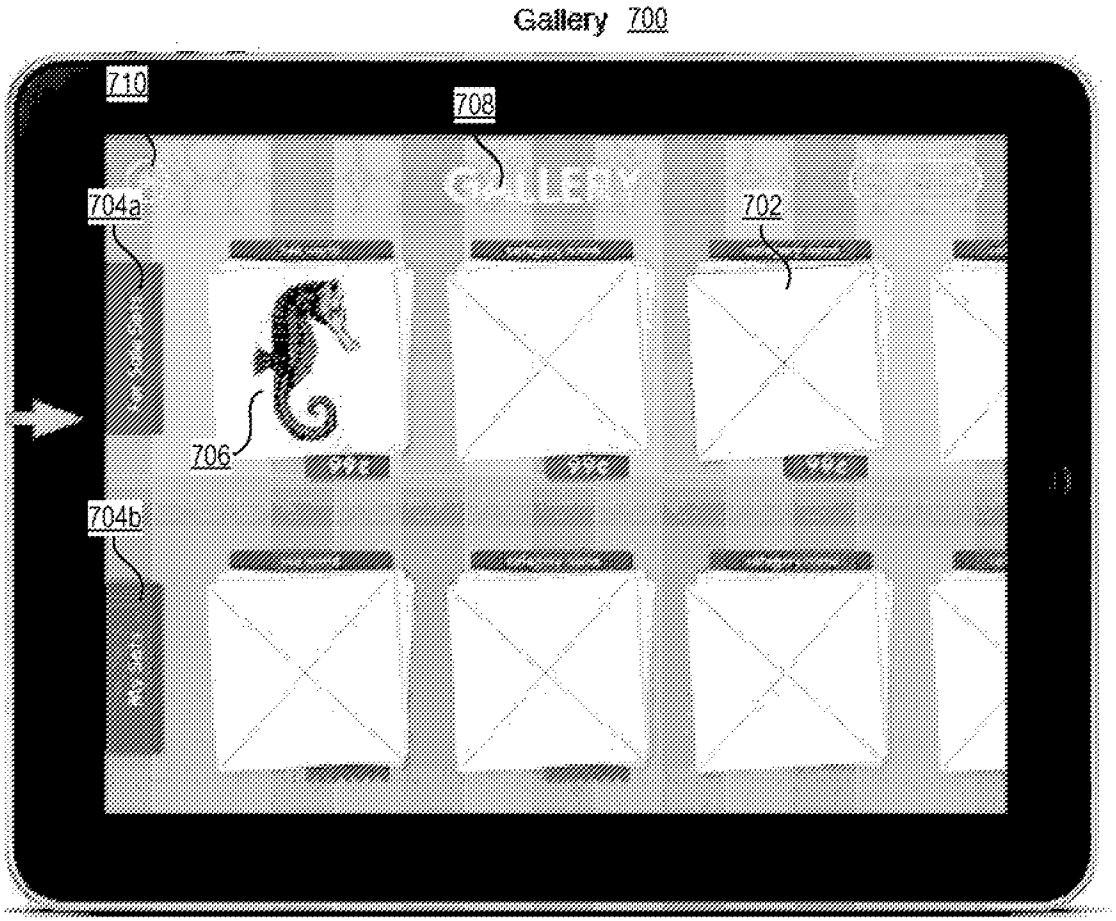

The user may select any of the user-selectable menus 604, 606, 608, 610 or 612 displayed on the home screen 600. The user may make the selection by, for example, touching on a menu. When the user selects the Start New menu 604, a gallery 700 may be displayed to the user, as shown in FIG. 7. When displaying the gallery 700, the images of beads of the home screen 600 may pop away on the home screen at the same time, while the bead counter 602 slides down off the home screen. As the beads pop away, the white overlay containers (e.g., container 702) and section headers for each section (e.g., sections 704*a* and 704*b*) in the gallery 700 may slide in from the right. Then the stacks of images (e.g., image 706) may follow in from the right. The main header 708 of the gallery 700 may pop in and bounce, and a back button 710 may fade in.

When the user selects the Start New menu 604, the user may be taken straight to the gallery 700. The user may also be given an option to be taken to a camera roll screen showing photos taken using a camera, to take a photo using the camera, or to go to the gallery 700. The camera may be integrated with the electronic device on which the system may be hosted.

Through the gallery 700, the user may select an image from which the user wishes to generate a hot melt bead pattern. The user may swipe the gallery 700 left and right to navigate the two sections 704*a* and 704*b*, which include various sets of images that may be used for generating the hot melt bead patterns. The section 704*a* may include sets of images that the user may purchase, and the section 704*b* may include sets of images that the user has already purchased or that are free. The purchased sets of images may be displayed in front of the free sets of images.

When the user selects a set of images that is for purchase, a pop up window is displayed to the user with more detail in the selected set. The pop up window includes the name of the set, a thumbnail image of each of the images in the set, the price and a short description of the set. The pop up window also includes a "buy" button for purchasing the set of images. A set of images may include, for example, six images. When the pop up window is displayed to the user, the pop up window may pop in and bounce once or twice and then settle, with all the information already present within the pop up window. The user may tap on the outside of the pop up window to close the pop up window.

When the user selects a set of images that is free, a pop up window is displayed which shows the details of the selected set. The pop up window for the free set includes the name of the set, a thumbnail image of each of the images included in the set, a short description, and a text prompting the user to select one of the images of the set to generate a hot melt bead pattern. A free set of images may include, for example, three images. When displaying the pop up window for the free set of images, the pop up window may bounce once or twice and then settle, with all the information already present in the pop up window. The user may tap on the outside of the pop up window to close the pop up window. Selecting any of the thumbnail images displayed in the pop up window may initiate generating a hot melt bead pattern based on the selected image.

Once the user has purchased a set of images for purchase, for example, from the section 704*a*, the purchased set appears on the section 704*b*. A newly purchased set may be displayed in front of any older purchased set. When the newly purchased set is displayed in the section 704*b*, an animation may be shown such that the newly purchased set appears to push the older sets over to make room for the newly purchased set. Selecting one of the purchased sets opens a pop up window with more detail on the selected set. The user may select a purchased set, for example, by tapping on the purchased set.

The displayed pop up window for the selected set includes the name of the set, a thumbnail image of each image in the set, and a text prompting the user to select one of the images to generate a hot melt bead pattern. The price of each image may be displayed as being crossed out, as the set of images is already purchased. When displaying the pop up window for the purchased set of images, the pop up window may bounce once or twice and then settle, with all the information already present in the pop up window. The user may tap on the outside of the pop up window to close the pop up window. Selecting any of the thumbnail images displayed in the pop up window may initiate generating a hot melt bead pattern based on the selected image.

When the user has selected an image to generate a hot melt bead pattern, the system begins generating a hot melt bead pattern based on the selected image. At the same time, an animation or text may be displayed to the user that provides an impression that the system is generating the hot melt bead pattern. A predetermined algorithm may be used for generating the hot melt bead pattern based on the selected image. In an aspect of the subject technology, the selected image may have a pre-generated hot melt bead pattern that is associated with the image. In such case, rather than generating a hot melt bead pattern, the system may identify the pre-generated hot melt bead pattern that is associated with the image.

Figure 8:
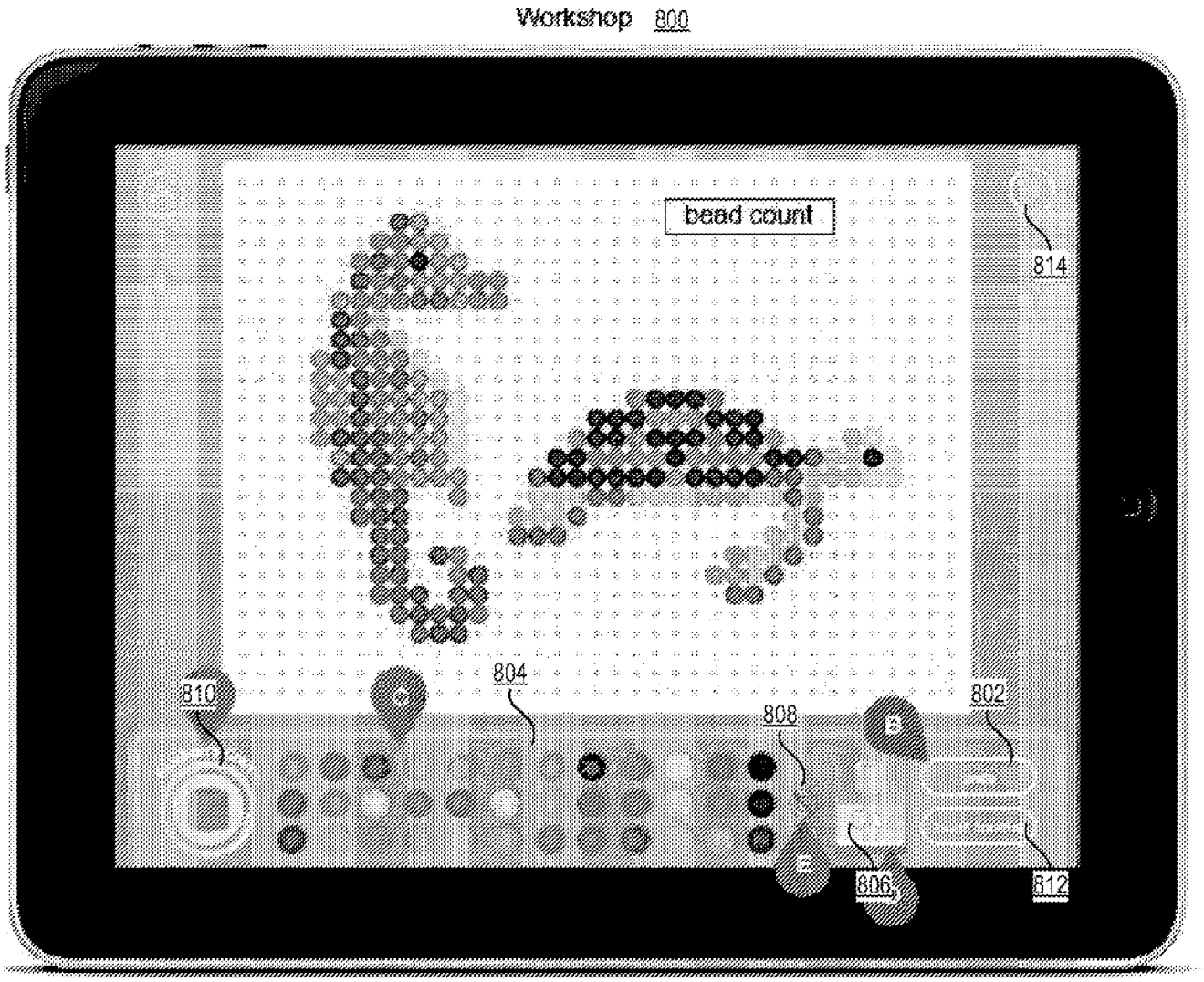

After the hot melt bead pattern is generated or identified, the hot melt bead pattern is displayed to the user, for example, at the workshop 800 as shown in FIG. 8. Before the hot melt bead pattern is displayed at the workshop 800, a full size version of the pattern may be displayed to the user for a predetermined period of time. The pattern then shrinks to fit into the workshop 800.

The hot melt bead pattern approximates the selected image using a plurality of circles having a predetermined size and predetermined number of colors. Each circle represents a bead. At the workshop 800, the hot melt bead pattern is displayed on top of a virtual pegboard, and the user may edit the colors of the beads on the virtual pegboard. To navigate through the virtual pegboard, the user may zoom in, for example, by performing a pinch action. While zoomed in, the user may also pan around the virtual pegboard by, for example, performing a tap and drag action.

When the user is finished with editing the hot melt bead pattern on the virtual pegboard, the user may save the edited hot melt bead pattern by selecting a "done" button (not shown). In such case, the hot melt bead pattern is saved in a "My Projects" section, which will be described in more detail below.

An "X" button (not shown) may also be provided on the workshop 800 which allows the user to close the workshop 800. When the user selects the "X" button, a pop up may be provided, asking if the user wants to save his or her project. If the user replies "yes," the hot melt bead pattern will be saved into the "My Projects" section. If the user replies "no," the pattern is not saved, and the user is taken back to the home screen 600. In an aspect of the subject technology, the hot melt bead pattern may be automatically saved in a temporary file each time the user changes a color of a bead on the virtual pegboard.

The workshop 800 includes an undo button 802, a bead color palette 804, a "color all of one color" button 806, a remove bead button 808, and a selected bead window 810.

The undo button 802 allows the user to undo color changes all the way back to the beginning state of a workshop session. The bead color palette 804 includes the different colors that are available for the beads on the virtual pegboard. The user may select beads on the virtual pegboard, and then apply a desired color on the bead color palette 804 by selecting a color. If the user wishes to change the color of beads of the same color all at the same time, the user may switch the "color all of one color" button 806 to the "multi" mode. In the multi mode, when the user selects a bead on the virtual pegboard and selects a color on the bead color palette 804, all beads having the same color as the selected bead will change their color to the newly selected color. The user may also remove a bead from the virtual pegboard by selecting the remove bead button 808 and selecting the bead that the user wishes to remove. The selected bead window 810 shows the bead color that is currently selected in the bead color palette 804, and the name of the color.

The workshop 800 also includes a bead counter button 812. Selecting the bead counter button 812 displays a window (not shown) which shows the count of all the current beads that are being used according to their colors.

Figure 9:
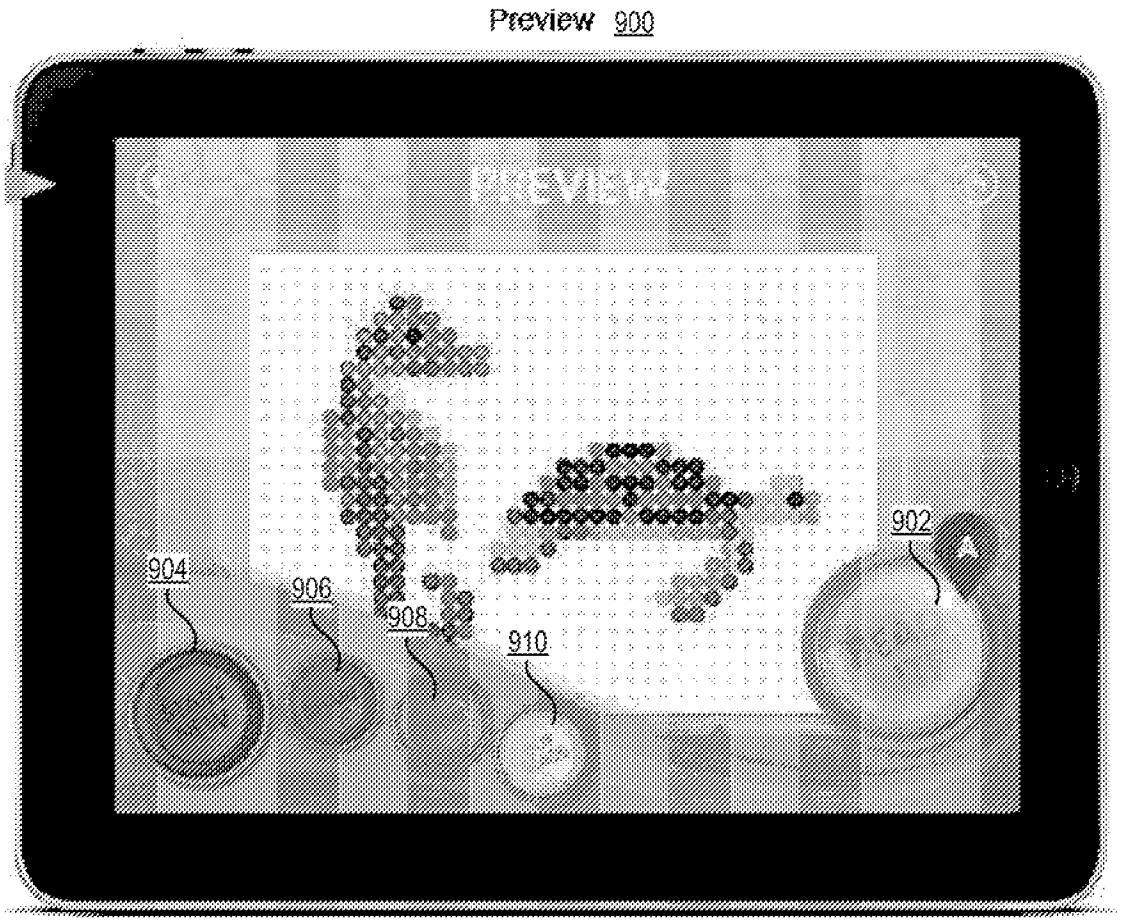

The workshop 800 also includes a next arrow 814. Selecting the next arrow 814 saves a copy of the hot melt bead pattern on the virtual pegboard to the "My Projects" section, and a preview screen 900 is displayed, as shown in FIG. 9. The preview screen 900 shows a preview of the hot melt bead pattern that the user has edited using the workshop 800. The preview screen 900 includes a "bead it" button 902. The bead it button 902 may be displayed to appear as if the button were glowing, to attract the user's attention to select the button. The bead it button 902 will be described in more detail below The preview screen 900 also includes a start new button 804, a share button 906, an export button 908, and a buy beads button 910. Selecting the start new button 904 takes the user back to the gallery 700, such that the user may start a new project. In an aspect of the subject technology, after selecting the start new button 904, the user may be provided with an option to be taken to a camera roll screen showing photos taken using a camera, to take a photo using the camera, or to go to the gallery 700.

Selecting the share button 906 provides the user an option to share the hot melt bead pattern. For example, selecting the share button 906 may display smaller buttons (not shown) representing one or more social networking sites and email. The smaller buttons may be displayed to the user as if they are shooting out from behind the share button 906 and spinning into an array. Tapping outside the smaller buttons may make the smaller buttons disappear.

When the user selects one of the displayed smaller buttons to share the hot melt bead pattern, a parental consent alert window may pop up, prompting the user to confirm that parental consent is obtained for sharing the hot melt bead pattern. The user may proceed after confirming that parental consent is obtained.

If the user selected a button representing a social networking site, the user is displayed with a screen for connecting to the social networking site. The user may connect to the social networking site by entering in his or her credentials. During this process, no personal information is stored in the system. After the user has connected to the social networking site, the user may be displayed with another screen for posting the hot melt bead pattern on the social networking site. For example, the user may be displayed with a screen prompting to add comments to be displayed with the shared hot melt bead pattern.

If the user selected a button representing email, the user is displayed with a screen for sending an email to a desired recipient. The email may be sent, for example, by an email application that may be installed at the electronic devices hosting the system. The hot melt bead pattern may be attached to a blank email as an image, and the user may enter the subject line, contents of the body, and a desired recipient to send out the email.

Selecting the export button 908 saves a copy of the hot melt bead pattern in the system. For example, the hot melt bead pattern may be stored in a camera roll section of the electronic device hosting the system, where photographs that are taken using a camera may be typically stored. The pattern may be stored, for example, as a JPEG image. An alert pop up window may also be displayed, notifying the user that the hot melt bead pattern is saved in the system.

Selecting the buy beads button 910 may take the user to a screen through which the user may purchase beads for use with the hot melt bead pattern. The screen may be, for example, a web store for purchasing the beads. The screen for purchasing the beads may display the number of beads for each color that are needed for the hot melt bead pattern displayed in the preview screen 900. A check box may also be displayed such that the user may check off each item as the user purchases the beads.

Figure 10:
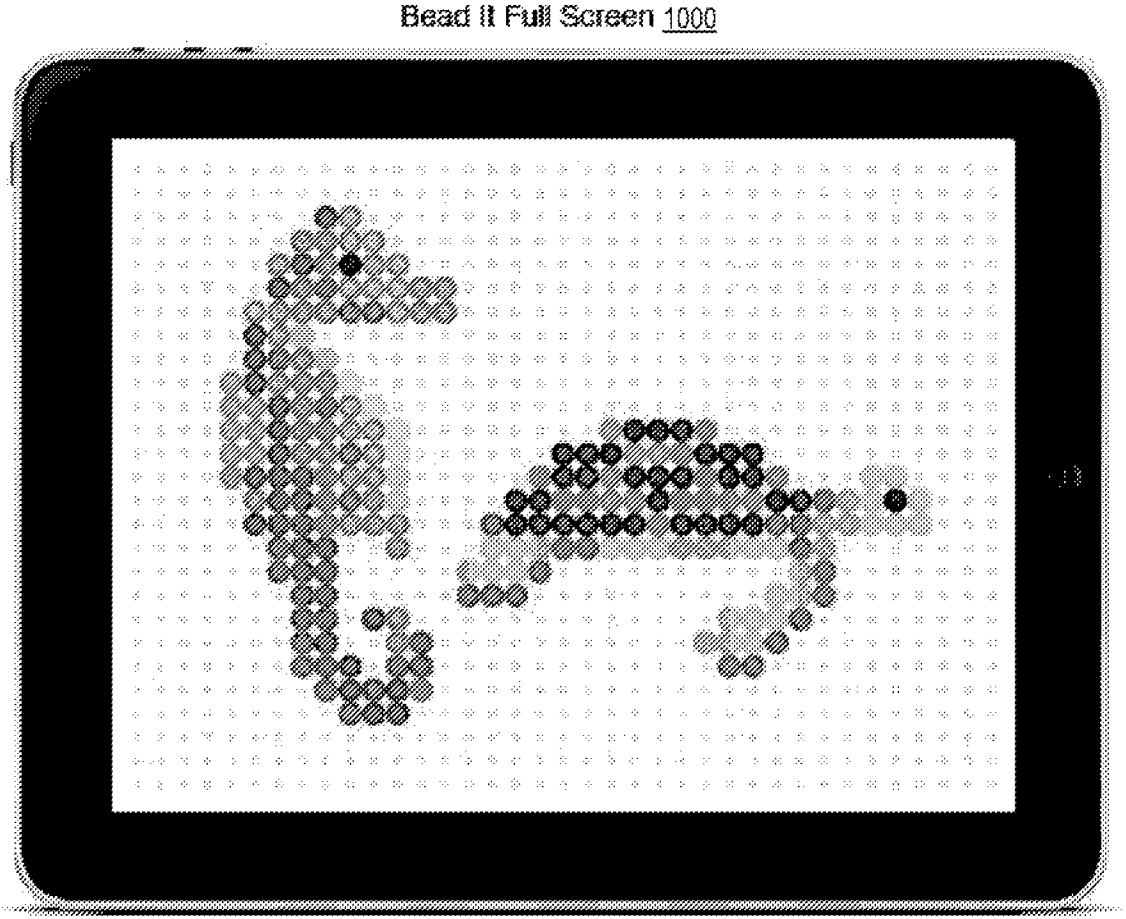
Figure 11:
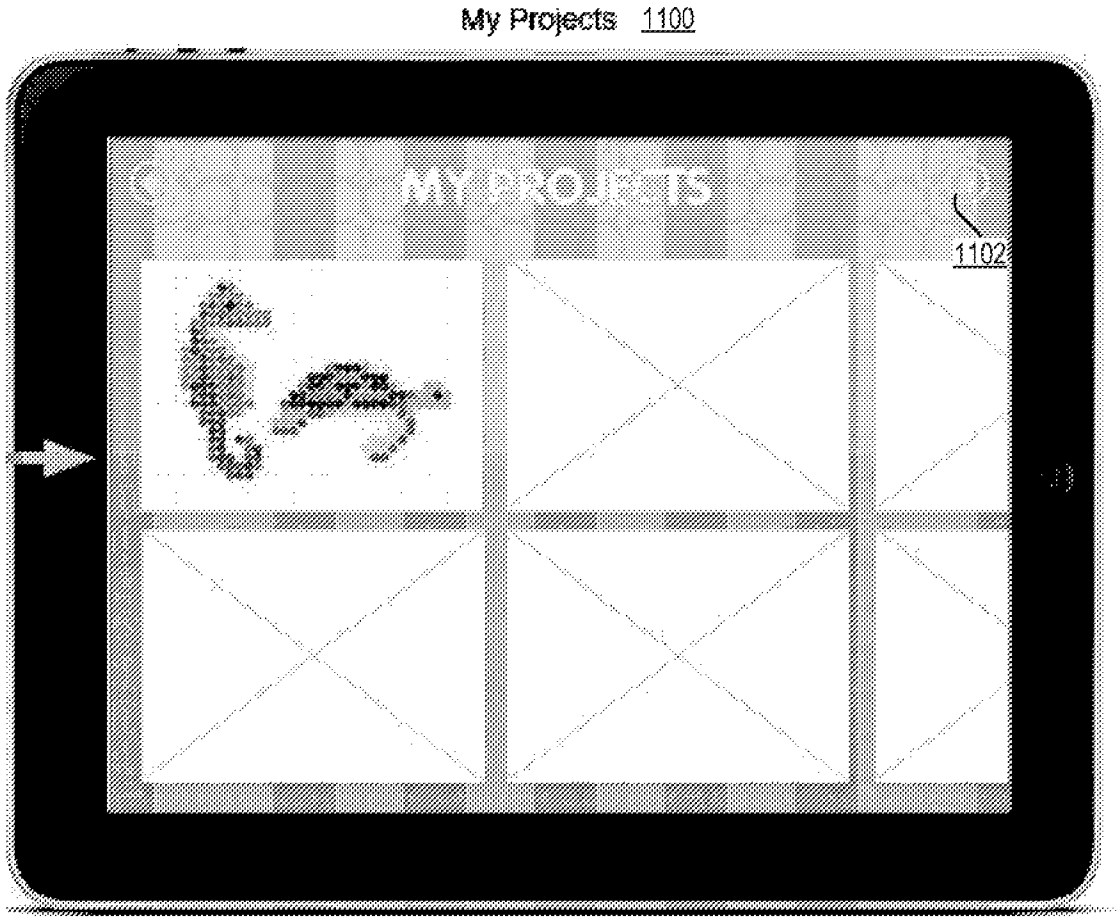

Selecting the bead it button 902 displays a full screen view 1000 of the hot melt bead pattern that is displayed in the preview screen 900. FIG. 10 shows the full screen view 1000. Before displaying the full screen view 1000, if the user is entering the full screen view 1000 for the first time, a pop up window may be displayed to the user, explaining to the user the purpose of the full screen view 1000.

After the full screen view 1000 is displayed to the user, the user may attach a physical pegboard (e.g., pegboard 22) to the electronic device that is hosting the system such that the user may place physical beads onto the physical pegboard using the hot melt bead pattern that is displayed on the view 1000 as a guide. The screen of the electronic device does not turn off or go into a sleep mode as long as the full screen view 1000 is displayed.

The user may tap anywhere on the full screen view 1000 to bring up an exit overlay. The exit overlay darkens the hot melt bead pattern that is displayed in the full screen view 1000, and also displays an exit button (not shown) for exiting the full screen view 1000. To go back to the full screen view 1000, the user may tap anywhere on the exit overlay outside of the exit button.

Referring back to home screen 600 of FIG. 6, selecting the "My Projects" menu 606 displays a "My Projects" screen 1100. The My Projects screen 1100 displays all the hot melt bead patterns that the user has created and saved as discussed above. The newest pattern may be displayed at the upper left corner. The user may swipe the screen to the right to view additional patterns, and tap a pattern to enter the preview screen 900. In an aspect of the subject technology, the up to forty patterns may be saved and displayed in the My Projects screen 1100. The user may be provided an option to delete existing patterns to make room for new patterns, if the user reaches the forty-pattern limit. For example, the My Projects screen 1100 may include a trashcan button 1102 for entering into a delete mode. In the delete mode, a delete icon may be displayed on top of each pattern. The user may select the delete icon on top of the pattern that the user wishes to delete, to remove the pattern from the My Projects screen 1100. Before deleting the pattern, the user may be displayed with a pop up window prompting the user to confirm deletion of the pattern. To exit the delete mode, the user may select the trashcan button 1102 again.

If the user selects the inspiration menu 608 at the home screen 600, the user is displayed with an inspiration screen (not shown). The inspiration screen may be similar to the gallery 700, but display images or patterns that may be suggested to the user by a service provider. The service provider may add new suggested images or patterns, which may be shown first. Clicking on any item that is displayed on the inspiration screen may display a new screen describing the details of the selected item. For example, selecting an item may display a web page showing the name or title of the selected item, thumbnail image for the item, and a link to the web site for the item.

Selecting the store menu 610 at the home screen 600 displays a store screen (not shown). The store screen may be similar to the gallery 700, but displays images and patterns that the user may purchase. The store screen may also display other products that are on sale. Selecting any item on the store screen displays another screen showing detailed information on the selected item, including the product name, thumbnail image of the product, price of the product, and a link to the product's web page.

Figure 13:
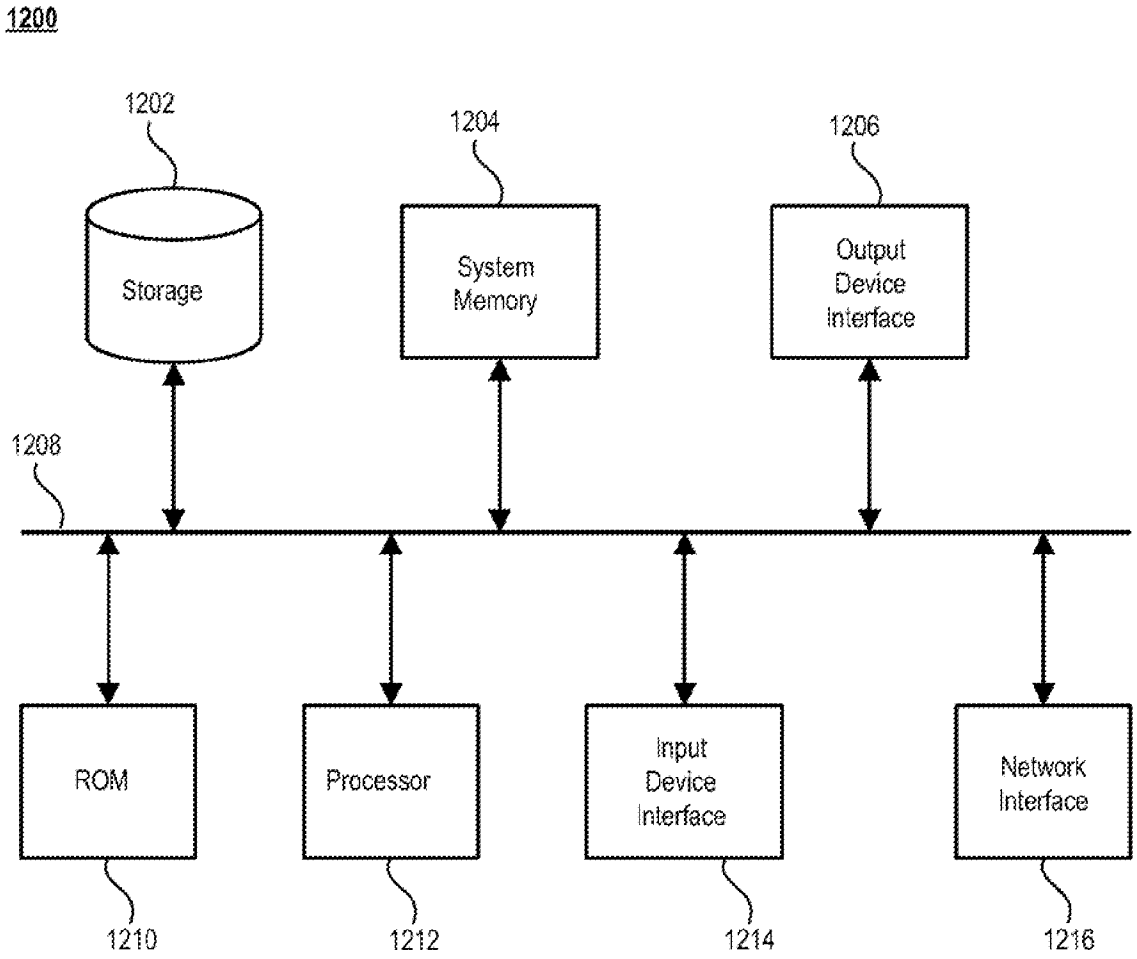
FIG. 13 conceptually illustrates an electronic system with which some aspects of the subject technology are implemented.

FIG. 13 conceptually illustrates an electronic system with which some aspects of the subject technology are implemented. Electronic system 1200 can be a server, computer, phone, PDA, laptop, tablet computer, television with one or more processors embedded therein or coupled thereto, or any other sort of electronic device. Such an electronic system includes various types of computer readable media and interfaces for various other types of computer readable media. Electronic system 1200 includes a bus 1208, processing unit(s) 1212, a system memory 1204, a read-only memory (ROM) 1210, a permanent storage device 1202, an input device interface 1214, an output device interface 1206, and a network interface 1216.

Bus 1208 collectively represents all system, peripheral, and chipset buses that communicatively connect the numerous internal devices of electronic system 1200. For instance, bus 1208 communicatively connects processing unit(s) 1212 with ROM 1210, system memory 1204, and permanent storage device 1202.

From these various memory units, processing unit(s) 1212 retrieves instructions to execute and data to process in order to execute the operations of the subject disclosure. The processing unit(s) can be a single processor or a multi-core processor in different implementations.

ROM 1210 stores static data and instructions that are needed by processing unit(s) 1212 and other modules of the electronic system. Permanent storage device 1202, on the other hand, is a read-and-write memory device. This device is a non-volatile memory unit that stores instructions and data even when electronic system 1200 is off. Some implementations of the subject disclosure use a mass-storage device (such as a magnetic or optical disk and its corresponding disk drive) as permanent storage device 1202.

Other implementations use a removable storage device (such as a floppy disk, flash drive, and its corresponding disk drive) as permanent storage device 1202. Like permanent storage device 1202, system memory 1204 is a read-and-write memory device. However, unlike storage device 1202, system memory 1204 is a volatile read-and-write memory, such a random access memory. System memory 1204 stores some of the instructions and data that the processor needs at runtime. In some implementations, the processes of the subject disclosure are stored in system memory 1204, permanent storage device 1202, and/or ROM 1210. From these various memory units, processing unit(s) 1212 retrieves instructions to execute and data to process in order to execute the processes of some implementations.

Bus 1208 also connects to input and output device interfaces 1214 and 1206. Input device interface 1214 enables the user to communicate information and select commands to the electronic system. Input devices used with input device interface 1214 include, for example, alphanumeric keyboards and pointing devices (also called "cursor control devices"). Output device interfaces 1206 enables, for example, the display of images generated by the electronic system 1200. Output devices used with output device interface 1206 include, for example, printers and display devices, such as televisions or other displays with one or more processors coupled thereto or embedded therein, or other appropriate computing devices that can be used for running an application. Some implementations include devices such as a touch screen that functions as both input and output devices.

Figure 12:
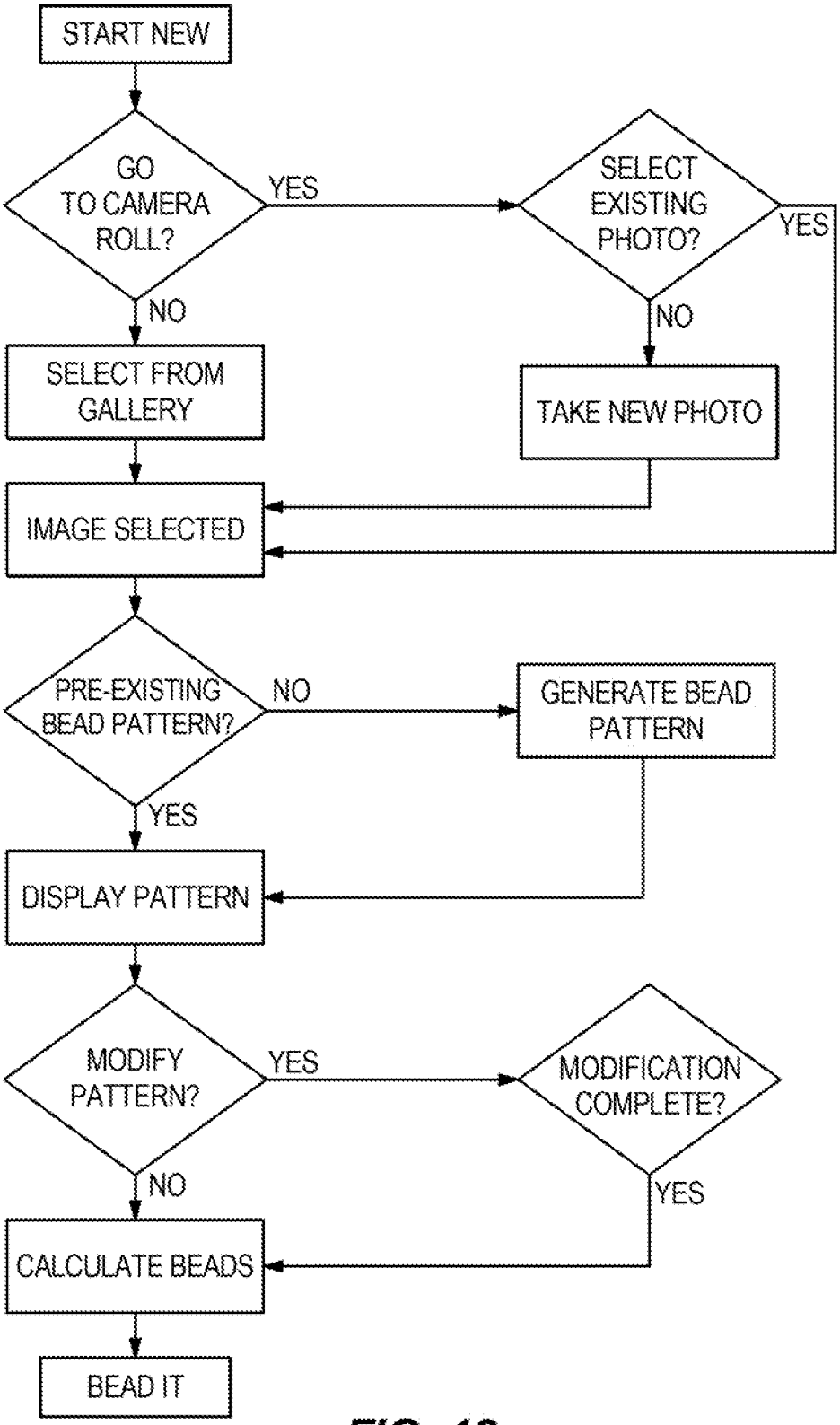
FIG. 12 is a flow illustrating an example method for generating a hot melt bead pattern for use with a pegboard.

Finally, as shown in FIG. 12, bus 1208 also couples electronic system 1200 to a network (not shown) through a network interface 1216. In this manner, the computer can be a part of a network of computers (such as a local area network ("LAN"), a wide area network ("WAN"), or an Intranet, or a network of networks, such as the Internet. Any or all components of electronic system 1200 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD- R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a device having a display device, e.g., televisions or other displays with one or more processors coupled thereto or embedded therein, or other appropriate computing devices that can be used for running an application, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

Process descriptions or blocks in figures should be understood as representing modules, segments, or portions of code which include one or more executable instructions for implementing specific logical functions or steps in the process. Alternate implementations are included within the scope of the embodiments of the present invention in which functions may be executed out of order from that shown or discussed, including substantially concurrently or in reverse order, depending on the functionality involved, as would be understood by those having ordinary skill in the art.

It is understood that any specific order or hierarchy of steps in the processes disclosed is an illustration of exemplary approaches. Based upon design preferences, it is understood that the specific order or hierarchy of steps in the processes may be rearranged, or that some illustrated steps may not be performed. Some of the steps may be performed simultaneously. For example, in certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

While the specific embodiments have been illustrated and described, numerous modifications come to mind without significantly departing from the spirit of the disclosure, and the scope of protection is only limited by the scope of the accompanying claims.

What is claimed is:

1. A beading board for arranging cylindrical beads in a pattern, the pattern displayed on an electronic display device, the beading board comprising:

a frame configured to receive the electronic display device, the frame defining a cavity for receiving the electronic display device, the frame defining a central recess positioned above the cavity, the central recess being configured to receive and orient a board; and a board including a plurality of bead receivers, the board being cooperatively received by the frame and configured to be supported over the electronic display device, wherein the electronic display device is viewable through the board.

2. The beading board of claim 1, wherein the plurality of receivers includes a plurality of equidistantly spaced pegs arranged in rows and columns.

3. The beading board of claim 1, wherein the frame includes a top surface surrounding the central recess, and wherein when the board is received by the central recess, tops of the plurality of bead receivers are located below the top surface of the frame.

4. The beading board of claim 3, wherein the board includes upwardly extending handles, and wherein when the board is received by the central recess, the handles extend above the top surface of the frame.

5. The beading board of claim 1, wherein the frame includes a plurality of resilient tabs extending into the cavity and configured for engagement with the electronic display device.

6. The beading board of claim 5, wherein the frame includes a perimeter wall defining the cavity, and wherein the plurality of resilient tabs are coupled to and extend inwardly from the perimeter wall.

7. The beading board of claim 1, wherein the frame includes a plurality of storage compartments spaced along at least one edge.

8. A beading board for arranging cylindrical beads in a pattern, the pattern displayed on an electronic display device, the beading board comprising:

a frame including a top surface, a perimeter wall defining a lower cavity, and a central recess extending downwardly from the top surface and defined by downwardly angled sidewalls; and a board including a base portion and a plurality of bead receivers extending upwardly from the base portion, the board being removably positionable within the central recess, wherein the sidewalls support the board when the board is positioned in the central recess, the cavity being viewable through the board when the board is positioned in the central recess.

9. The beading board of claim 8, wherein tops of the plurality of bead receivers are located below the top surface when the board is positioned in the central recess.

10. The beading board of claim 8, wherein the board includes at least one upwardly extending handle, the handle extending above the top surface when the board is positioned in the central recess.

11. The beading board of claim 8, further comprising a plurality of resilient tabs coupled to the perimeter wall and extending inwardly into the cavity.

12. A system for arranging cylindrical beads in a pattern, the system comprising:

a non-transitory computer readable medium adapted to control a computer and providing code segments for displaying a bead pattern on an electronic display device; and a beading board including a frame configured to receive the electronic display device, and a board supported by the frame over the electronic display device, the frame including a top surface, a perimeter wall defining a lower cavity, and a central recess extending downwardly from the top surface and defined by downwardly angled sidewalls, the board including a plurality of bead receivers, wherein the sidewalls support the board when the board is positioned in the central recess; and wherein the bead pattern on the electronic display device is viewable through the board.

13. The system of claim 12, wherein the bead receivers are arranged in a receiver pattern, and wherein the bead pattern on the display corresponds to the receiver pattern of the bead receivers.

14. The system of claim 12, wherein the non-transitory computer readable medium further provides a code segment for receiving a user selection of an image.

15. The system of claim 14, wherein the non-transitory computer readable medium further provides a code segment for generating the bead pattern from the image selected by the user.

16. The system of claim 12, wherein the non-transitory computer readable medium further provides a code segment for receiving user modifications to the bead pattern.

17. The system of claim 12, wherein the non-transitory computer readable medium further provides a code segment for calculating a total number of cylindrical beads required by the bead pattern and displaying the total number of cylindrical beads on the display.

* * * * *